United States Patent [19]

Saltin

[11] 4,266,463

[45] May 12, 1981

[54] FIRE CONTROL DEVICE

[75] Inventor: Malte Saltin, Karlskoga, Sweden

[73] Assignee: Aktiebolaget Bofors, Sweden

[21] Appl. No.: 974,591

[22] Filed: Dec. 29, 1978

[30] Foreign Application Priority Data

Jan. 18, 1978 [SE] Sweden ..... 7800577

[51] Int. Cl.[3] ..... F41G 3/14

[52] U.S. Cl. ..... 89/41 AA; 89/41 L; 356/255

[58] Field of Search ..... 89/41 D, 41 AA, 41 MC, 89/41 ME, 41 L, 41 TV, 41 SW, 41 E, 41 EA; 356/247, 251, 252, 253, 254, 255

[56] References Cited

U.S. PATENT DOCUMENTS

| | | | |
|---|---|---|---|
| 2,186,007 | 1/1940 | Chamberlain | 89/41 AA |
| 2,458,448 | 1/1949 | Tuttle | 89/41 AA |
| 4,004,487 | 1/1977 | Eichweber | 89/41 L |
| 4,146,780 | 3/1979 | Sprey | 89/41 AA |

*Primary Examiner*—Stephen C. Bentley

*Attorney, Agent, or Firm*—Pollock, Vande Sande & Priddy

[57] ABSTRACT

The present invention relates to a fire control assembly wherein a first sighting device is spaced from at least one weapon and a second sighting device is mounted for joint movement with the weapon. Each sighting device has a field of view and the two sighting devices are positioned sufficiently close to one another so as to neglect the relative parallax effect on the fields-of-view. A reticule mounted in the second sighting device is automatically positioned such that its line of sight intercepts the present position of the moving target only when the line-of-fire of the weapon intercepts the projected path of the target.

10 Claims, 4 Drawing Figures

FIRE CONTROL DEVICE

BACKGROUND ART

The present invention relates to a fire control device for aiming of weapons, particularly anti-aircraft guns, at a target which is to be fired upon.

Such a fire control device usually includes a sighting device with which the direction and range to the target can be measured and also a fire control calculator. On the basis of the values obtained from the sighting device of the direction and range to the target and other necessary data, such as the movement of the target, wind conditions, parallax etc., the fire control calculator calculates the necessary data for aiming of the weapon with which the target is to be fired upon.

Fire control equipment for anti-aircraft guns hitherto used has been of two kinds; the equipment has either been placed on the gun or else the equipment has been placed separate from the gun, wherein data from the fire control equipment is transmitted by means of cables to the gun, which is remotely controlled from the fire control equipment. Both of these methods involve certain disadvantages. A fire control device placed on the gun can only control the gun on which it is placed. A separate set of fire control equipment is therefore required for each gun, which involves a high cost for the system. The other alternative is to place the fire control equipment separate from the gun. The equipment can then control several guns simultaneously, but difficulties are then encountered with the accuracy of the system, as the sighting equipment and the guns must be aligned very accurately when setting up the system. This applies to both levelling of the sight and guns as well as the transverse setting.

A further difficulty confronting known prior art devices is that the angle transmission from the sight to the guns must have a high degree of accuracy. The transmission can take place with so-called synchros with fine and coarse systems, but this requires the use of either heavy transmission cables with many conductors, or transmission with pulse code modulation on a double conductor, which involves complicated extra equipment.

SUMMARY OF THE INVENTION

The purpose of the present invention is to provide improved fire control equipment of the above-mentioned kind, which has high accuracy and low cost, and in which the difficulties confronting the prior art are avoided. The present invention provides a first sighting device separate from the weapons for determining the direction and range to the target and second sighting devices arranged on the weapons for aiming at the target. The first sighting device comprises means for calculating the necessary angles of aim-off and tangent elevation for the weapons and also means for transmission of information about said angles to the second sighting devices for control of the weapons.

BRIEF DESCRIPTION OF THE DRAWINGS

The invention will be described in more detail in the following, with reference to the accompanying drawings, in which.

DETAILED DESCRIPTION OF PREFERRED EMBODIMENT

Figure 1:
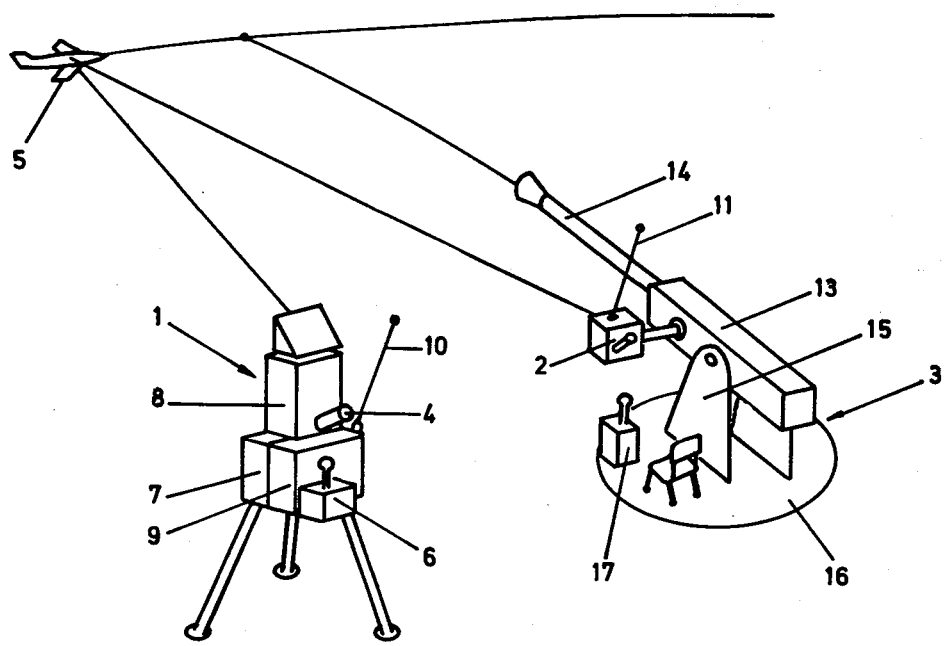
FIG. 1 schematically shows an overall view of a preferred embodiment of the present invention.

The fire control equipment shown as an example and illustrated schematically in FIG. 1 includes a first separate sight 1, for instance of a periscopic type, and a second sight 2 mounted on a weapon in the form of an anti-aircraft gun 3. The first sight includes an ocular 4 through which an operator can observe the target, which may take the form of an aircraft 5. The operator follows the target with the aid of a control lever 6, which actuates servo motors which are built into a unit 7 in the sight 1. The servo motors cause the periscopic sight to elevate and traverse in a known way, so that the line of sight of the sight 1 is continuously aimed at the moving target during tracking. A laser range finder 8 is also connected to the periscopic sight 1 in order to measure the range to the target 5.

The sight 1 also includes a calculating unit 9, which in a known way with the aid of the range measured to the target calculates the necessary angles of aim-off and tangent elevation for the gun 3. In this calculation, the parallax distance between the sight 1 and the gun 3 is neglected, as a calculation has shown that the error caused by this will be small as long as the distance between the sight 1 and the gun 3 does not exceed approx. 50 m. Information about the angles of aim-off and tangent elevation is transmitted by radio from the calculating unit 9 to the second sight 2 on the weapon with the aid of a transmitter unit which comprises a transmitter antenna 10 on the sight 1 and a receiver part with a receiver antenna 11 on the gun 3.

The second sight 2 is mounted with the aid of an arm 12 extending from the elevating mass 13 of a conventional gun 3. The gun comprises a barrel 14 which is supported so that it can be elevated in a mounting 15 which is installed on a rotatable platform 16. The barrel 14 can thus be both traversed and elevated in relation to a base not shown in detail in the drawing. In the example of the embodiment shown, the traversing and elevation takes place with the aid of servo motors, not shown in FIG. 1. The servo motors are controlled with the aid of a control lever 17 on the platform 16 of the gun.

Figure 2:
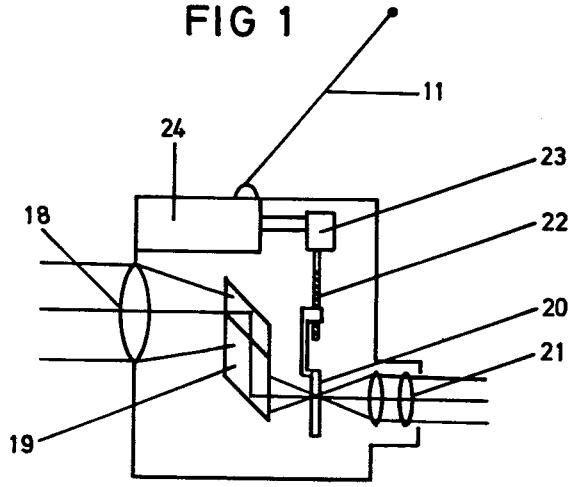
FIG. 2 shows schematically the arrangement of the second sighting devices provided in the invention.

The arrangement of the sight 2 is schematically illustrated in FIG. 2. The sight comprises a single objective in the form of an objective 18, a conventional prism system 19 for producing a correct representation of the image received by the objective, a reticule 20 with cross hairs and an ocular 21 through which an operator can observe the target and its background. The reticule 20 can be displaced vertically with the aid of a screw 22 and a servo motor 23. With the aid of a similar system which, however, is not shown in the figure, the reticule 20 can also be displaced horizontally. The servo motor 23 is controlled by an amplifier and radio unit 24 which receives a radio signal from the first sight 1 via the receiver antenna 11.

When using the fire control system, a first operator is placed at the first sight 1. He follows the target and measures the range with the aid of the laser range finder 8. In the calculating unit 9 the necessary tangent elevation and aim-off angles are calculated, which values are thereafter transmitted to the gun with the aid of the radio, and the reticule 20 in the second sight 2 is displaced distances in elevation and traverse corresponding to the tangent elevation angle. On the gun 3 there is a second operator who with the aid of the control lever 17 aims the gun 3 so that the cross hairs in the reticule 20 coincide with the target 5. The operator on the gun 3 can thereafter fire a salvo.

It should be obvious from the description given above that with a system according to the invention a high degree of accuracy is obtained without any sight-setting between the sight 1 and the gun 3 being required. Both the sight and the gun need to be roughly levelled, but the requirements for levelling accuracy are of a lesser magnitude than for a conventional system with the sight separate from the gun. The change of the levelling which can be caused by the firing of the gun has little influence on the total accuracy with the system described.

Figure 3:
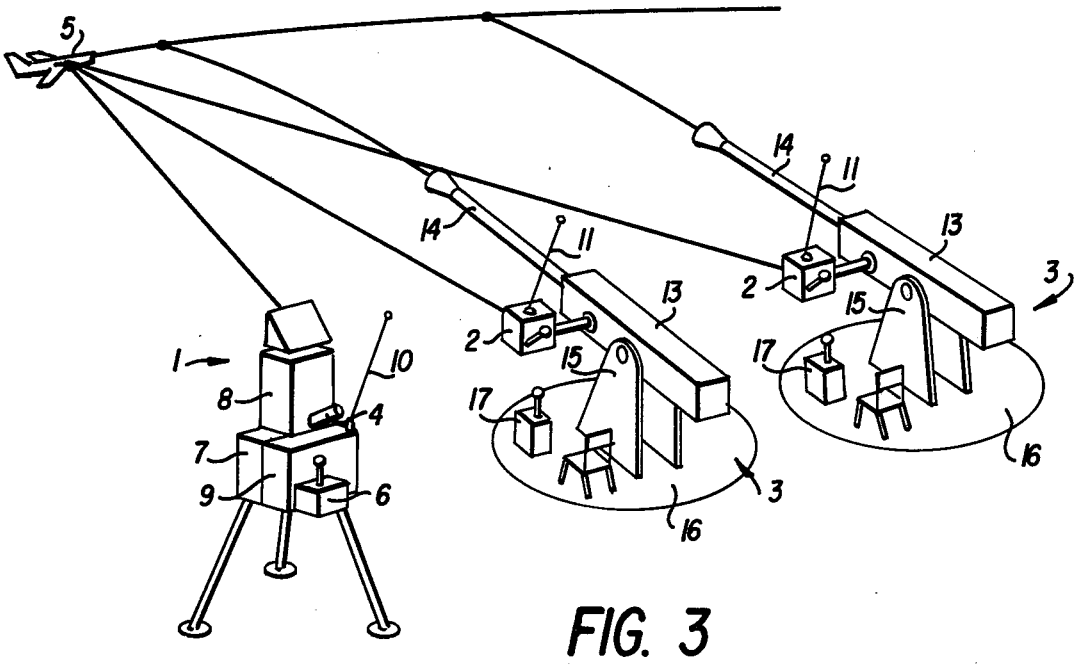
FIG. 3 schematically shows an overall view of an alternative embodiment of the present invention; and, FIG. 4 schematically shows an overall view of a yet further embodiment of the present invention.

In the foregoing, the system has been described with the aid of a favourable embodiment in the form of a separate sight and one gun which is controlled by the sight. However, it is possible according to the invention, to control a plurality of guns with the separate sight. Sights of the kind shown in FIG. 2 are then mounted on each and every one of the guns. Such an embodiment is shown in FIG. 3, wherein sight 1 controls the sighting operation of each of the guns 3. It is evident that the plurality of guns 3 need not be limited to the two guns 3 used in the example shown in FIG. 3.

The transmission of the angle information between the separate sight 1 and the gun sight 2 need not necessarily take place with the aid of radio, but can also be accomplished in other ways, for instance with the aid of an electric conductor or light signals. The target acquisition at the separate sight and at the gun can take place with aids other than visual optics, for instance with radar, IR or TV. It is moreover possible to utilize the invention even if the gun is not power-operated, but is aimed for instance with the aid of hand cranks. It is likewise conceivable to allow the separate sight 1 to be hand-operated.

Figure 4:
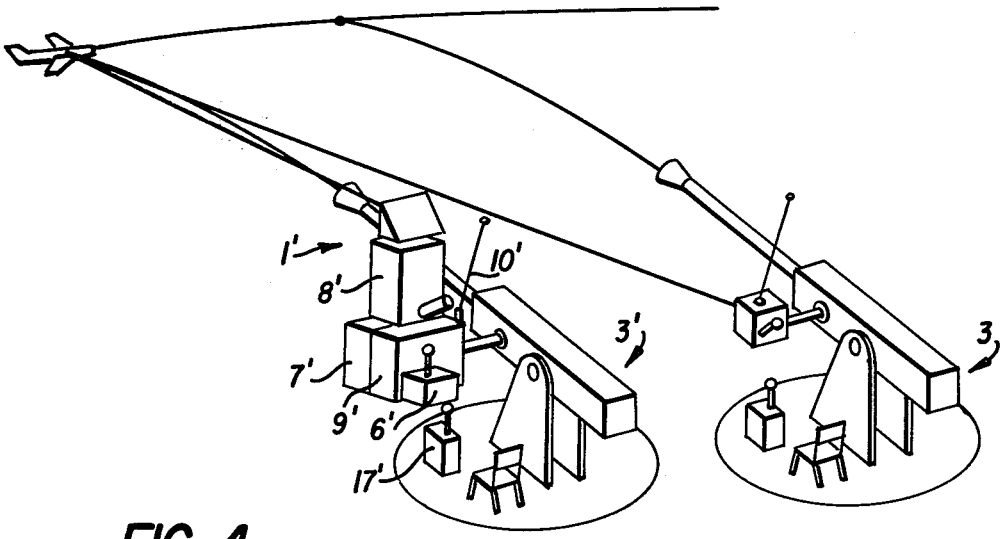

A further variation within the scope of the invention is also to have the separate sight 1 placed on one weapon, for instance an anti-aircraft gun, and to use this in a conventional way to aim the gun at a point of aim-off, while a second gun is aimed at the same point of aim-off with the aid of the invention described. Such an arrangement is shown in FIG. 4, wherein sight 1' is mounted on gun 3' and is employed to control the sighting of guns 3' and 3.

I claim:

1. A fire control assembly for aiming of at least one weapon such that a projectile fired along a line-of fire of said weapon intercepts a target moving relative to said at least one weapon, and comprising:

first means spaced from said at least one weapon and having a tracking means for tracking said moving target and also ranging means for determining the distance between said moving target and said first means;

control means responsive to said tracking means and said ranging means for generating at least one command signal representative of the line-of-sight of said tracking means to the target and also of the distance between said target and said first means;

a sighting device mounted for joint movement with said at least one weapon and having a sighting means for tracking said moving target in a field-of-view of said sighting device;

said first means and said sighting device being positioned sufficiently close to one another so as to substantially eliminate the parallax effect therebetween;

said sighting device further including a sighting assembly providing an adjustable line-of-sight within the field-of-view of said sighting device; and means for adjusting the line-of-sight of said sighting device in response to said command signal;

whereby said signal generated by said control means varies the line-of-sight of said sighting device such that the aiming of said weapon to cause said line-of-sight of said sighting device to impinge upon the target causes the weapon's line-of-fire to intercept the projected position of the moving target.

2. A fire control assembly according to claim 1, wherein said tracking means comprises a periscopic optical sighting assembly adjustably mounted on a base portion of said first means.

3. A fire control assembly according to claim 1, wherein said ranging means comprises a laser range finder assembly mounted a said base portion of said first means.

4. A fire control assembly according to claim 1, wherein said second sighting device comprises an optical sighting device mounted on an elevating mass of said at least one weapon.

5. A fire control assembly according to claim 1, wherein said sighting assembly comprises a reticule having an adjustable line-of-sight within the field-of-view of said second sighting device.

6. A fire control assembly according to claim 1, wherein said means for adjusting the line-of-sight of said sighting device comprises at least one first servo device attached to said sighting assembly via a horizontally extending screw device, said means for adjusting said line-of-sight of said sighting assembly further comprises at least one second servo device attached to said sighting means via a vertically extending screw device, whereupon actuation of said first servo device moves said sighting device in a horizontal direction and actuation of said second servo device moves said sighting device in a vertical direction.

7. A fire control assembly according to claim 6, wherein said control means comprises a radio transmitter unit mounted on said first means and a radio receiver mounted on said sighting device.

8. A fire control assembly according to claim 6, wherein said control means further comprises a separate calculating unit mounted on said first means and capable of calculating necessary the angles of aim-off and target elevation for said at least one weapon responsive to data received from said tracking means and said ranging means.

9. A fire control assembly according to claim 1, wherein said first means is mounted on a further weapon spaced from said at least one weapon supporting said sighting device.

10. A fire control assembly for aiming a plurality of weapons such that a separate projectile fired along a line-of-fire of each of said weapons intercepts a target moving relative to said weapons, and comprising:

first means spaced from each of said weapons and having a tracking means for tracking said moving target and also ranging means for determining the distance between said moving target and said first means;

control means responsive to said tracking means and said ranging means for generating at least one command signal representative of the line-of-sight of said tracking means to the target and also of the distance between said target and said first means;

a plurality of separate sighting devices each mounted for joint movement with a separate one of said weapons and each sighting device having a sighting means for tracking said moving target in a field-of-view of said respective sighting device;

said first means being positioned sufficiently close to each of said plurality of sighting devices so as to substantially eliminate the parallax effect therebetween;

each of said plurality of separate sighting devices further including a sighting assembly providing an adjustable line-of-sight within the field-of-view of said respective sighting device; and means for adjusting the line-of-sight of each of said sighting devices in response to said command signal;

whereby said signal generated by said control means varies the line-of-sight of each of said sighting devices such that aiming of each of said weapons to cause said line-of-sight of said respective sighting device to impinge upon the target causes said respective weapon's line-of-fire to intercept the projected position of the moving target.

* * * * *